US008362709B2

(12) United States Patent
Chong et al.

(10) Patent No.: US 8,362,709 B2
(45) Date of Patent: Jan. 29, 2013

(54) CURRENT BALANCE CIRCUIT HAVING PROTECTION FUNCTION, AND POWER SUPPLY

(75) Inventors: Won Sik Chong, Gyunggi-do (KR); Jong Rak Kim, Gyunggi-do (KR); Kyoung Ho Yoon, Gyunggi-do (KR); Yoon Seok Seo, Incheon (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 379 days.

(21) Appl. No.: 12/640,259

(22) Filed: Dec. 17, 2009

(65) Prior Publication Data

US 2011/0050105 A1 Mar. 3, 2011

(30) Foreign Application Priority Data

Aug. 25, 2009 (KR) ..... 10-2009-0078755

(51) Int. Cl.
*H05B 37/02* (2006.01)

(52) U.S. Cl. ..... 315/291; 315/276; 315/277; 315/308

(58) Field of Classification Search ..... 315/200 R, 315/291, 307, 312, 205, 206, 209 R, 227 R, 315/228, 276, 277
See application file for complete search history.

(56) References Cited

U.S. PATENT DOCUMENTS

2005/0017647 A1* 1/2005 Huang ..... 315/119
2006/0158124 A1* 7/2006 Hosaka et al. ..... 315/82
2010/0060191 A1* 3/2010 Ashikaga et al. ..... 315/291

FOREIGN PATENT DOCUMENTS

JP 06140182 A 5/1994
KR 1020070021988 2/2007
KR 100780181 B1 11/2007

OTHER PUBLICATIONS

Korean Office Action for Application No. 10-2009-0078755, issued Jan. 24, 2011.

* cited by examiner

*Primary Examiner* — Jimmy Vu
(74) *Attorney, Agent, or Firm* — Lowe Hauptman Ham & Berner LLP

(57) ABSTRACT

There are provided a current balance circuit having a protection function that prevents the current balance circuit from being damaged during a preset time period by maintaining a constant level of power being supplied to the lamp, and a power supply. The current balance circuit having the protection function includes a current balance unit maintaining current balance of lamp driving power supplied to a lamp unit including a plurality of lamps, and a protection unit detecting the lamp driving power supplied to the lamp unit from the current balance unit, cutting-off the lamp driving power after a preset time period when the lamp operates abnormally, and controlling a voltage level of the lamp driving power to a preset reference voltage level or lower during the preset time period.

10 Claims, 3 Drawing Sheets

CURRENT BALANCE CIRCUIT HAVING PROTECTION FUNCTION, AND POWER SUPPLY

CROSS-REFERENCE TO RELATED APPLICATIONS

This application claims the priority of Korean Patent Application No. 10-2009-0078755 filed on Aug. 25, 2009, in the Korean Intellectual Property Office, the disclosure of which is incorporated herein by reference.

BACKGROUND OF THE INVENTION

1. Field of the Invention

The present invention relates to a current balance circuit and a power supply, and more particularly, to a current balance circuit having a protection function that protects a device by detecting an abnormal lamp operation after a predetermined time period in order to ensure a normal lamp operation, and further having a protection function that prevents the current balance circuit from being damaged during the preset time period by maintaining a constant level of power, being supplied to the lamp, and a power supply including the same.

2. Description of the Related Art

Recently, much attention has been drawn to liquid crystal display (LCD) devices that are smaller and lighter than existing display devices.

An LCD device necessarily employs a backlight unit that emits light. In addition, the LCD device may be provided with a power supply to supply power to lamps of the backlight unit.

The power supply may include a power supply circuit supplying power to lamps, and a current balance circuit maintaining the current balance of power being supplied to the lamps.

The current balance circuit may have a protection function that prevents device breakdown caused by an abnormal lamp operation such as an open lamp.

After a backlight unit having the above configuration is manufactured, commercial power is supplied to this backlight unit to check whether or not it is operating normally. To this end, the protection function of a current balance circuit is performed after a predetermined time period.

For a reduction in manufacturing costs, a current balance circuit, which had formerly been employed at each end of a lamp, is currently employed only at a single end of a lamp. Thus, the level of a voltage applied to the coil of the current balance circuit has been doubled compared to that of existing examples. For this reason, under the open-lamp condition, the coil may be burnt out due to the overvoltage applied to the coil.

SUMMARY OF THE INVENTION

An aspect of the present invention provides a current balance circuit having a protection function that protects a device by detecting an abnormal lamp operation after a predetermined time period in order to ensure a normal lamp operation, and further having a protection function that prevents the current balance circuit from being damaged during the preset time period by maintaining a constant level of power, being supplied to the lamp, and a power supply including the same.

According to an aspect of the present invention, there is provided a current balance circuit having a protection function, the current balance circuit including: a current balance unit maintaining current balance of lamp driving power supplied to a lamp unit including a plurality of lamps; and a protection unit detecting the lamp driving power supplied to the lamp unit from the current balance unit, cutting-off the lamp driving power after a preset time period when the lamp operates abnormally, and controlling a voltage level of the lamp driving power to a preset reference voltage level or lower during the preset time period.

The current balance unit may include a plurality of current balancing transformers corresponding with the plurality of lamps on a one-to-one basis and maintaining the current balance of the lamp driving power, the current balancing transformers each including: a primary winding receiving the lamp driving power and sending the received lamp driving power to a corresponding lamp among the plurality of lamps; and a secondary winding electromagnetically coupled with the primary winding and electrically connected to an adjacent current balancing transformer among the plurality of current balancing transformers to form at least one loop and maintain current balance.

The protection unit may include: a detection part detecting power induced from the secondary winding of the current balancing transformer; a delay transmission part delaying a detected voltage from the detection part by the preset time period and sending the delayed voltage to the outside; and a regulation part receiving the detected voltage from the detection part and regulating a voltage level of the lamp driving power to a preset voltage level during the preset time period.

The detection part may include: a plurality of tertiary windings included in the plurality of current balancing transformers and inducing and receiving power from the respective secondary windings; and a diode group rectifying power from each of the plurality of tertiary windings.

The delay transmission part may include: a comparator comparing the detected voltage with a preset reference voltage; and a delay delaying a comparison result from the comparator by the preset time period and outputting the delayed comparison result.

The regulation part may include: a diode rectifying the detected voltage; a resistor reducing a voltage from the diode; a capacitor charged with the voltage from the resistor; and a discharge resistor discharging the voltage charged in the capacitor.

According to another aspect of the present invention, there is provided a power supply having a protection function, the power supply including: a power supply circuit converting commercial alternating current (AC) power into preset lamp driving power and supplying the lamp driving power to a lamp unit including a plurality of lamps; and a current balance circuit including: a current balance unit maintaining the current balance of a lamp driving power being supplied from the power supply circuit to each of the plurality of lamps; and a protection unit detecting the lamp driving power supplied to the lamp unit from the current balance unit, cutting off the lamp driving power after a preset time period when the lamp operates abnormally, and controlling a voltage level of the lamp driving power to a preset reference voltage level or lower during the preset time period.

The power supply circuit may include: a rectification unit rectifying and smoothing commercial AC power; a power factor correction unit correcting a power factor of the rectified power from the rectification unit; an inverter unit switching the corrected power from the power factor correction unit; a transformer unit transforming the switched power from the inverter unit into the lamp driving power; and a control unit controlling a switching operation of the inverter unit according to a signal from the protection unit.

The control unit may adjust an ON/OFF duty of the inverter unit according to a control signal from the protection unit, and cut-off the switching operation of the inverter unit according to a cut-off signal from the protection unit.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
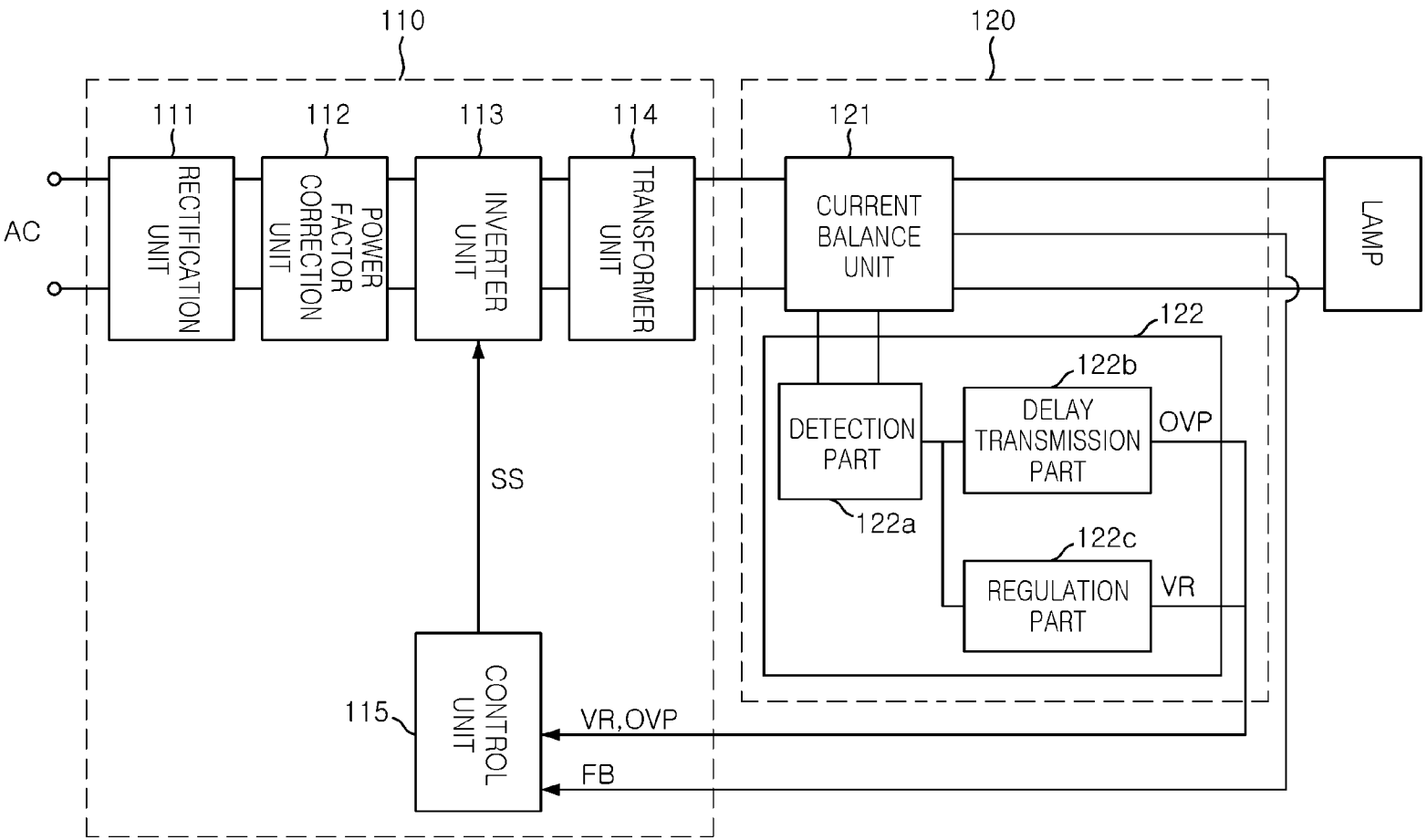
FIG. 1 is a schematic view illustrating the configuration of a power supply according to an exemplary embodiment of the present invention.

FIG. 1 is a schematic view illustrating the configuration of a power supply according to an exemplary embodiment of the present invention.

Referring to FIG. 1, a power supply 100, according to this embodiment, may include a power supply circuit 110 and a current balance circuit 120.

The power supply circuit 110 may include a rectification unit 111, a power factor correction unit 112, an inverter unit 113, a transformer unit 114 and a control unit 115.

The rectification unit 111 may rectify and smooth commercial alternating current (AC) power.

The power factor correction unit 112 may correct a power factor by adjusting a phase difference between the current and voltage of rectified power from the rectification unit 111.

The inverter unit 113 converts power by switching the corrected power from the power factor correction unit 112.

The transformer unit 114 supplies lamp driving power to lamps by transforming switched power from the inverter unit 113 according to a preset turns ratio.

The control unit 115 may control the switching operation of the inverter unit 113 according to a feedback signal FB of the lamp driving power supplied to lamps, and a control signal VR and a cut-off signal OVP from the current balance circuit 120. The control unit 115 may adjust an ON/OFF duty of the inverter unit 113 according to the control signal VR from the current balance circuit 120, and stop the switching operation of the inverter unit 113 according to the cut-off signal OVP from the current balance circuit 120.

The current balance circuit 120 may include a current balance unit 121, and a protection unit 122.

The current balance unit 121 may maintain the current balance of the lamp driving power sent from the power supply circuit 110 to each lamp of a lamp unit.

The protection unit 122 may include a detection part 122*a* detecting the voltage of lamp driving power sent from the current balance unit 121 to each lamp, a delay transmission part 122*b* delaying a detection result obtained by the detection part 122*a* by a preset time period and transmitting a cut-off signal OVP after the preset time period, and a regulation part 122*c* transmitting a control signal VR to the control unit 115 according to the detection result from the detection part 122*a* so that the lamp driving power has a preset voltage level during the preset time period.

Figure 2:
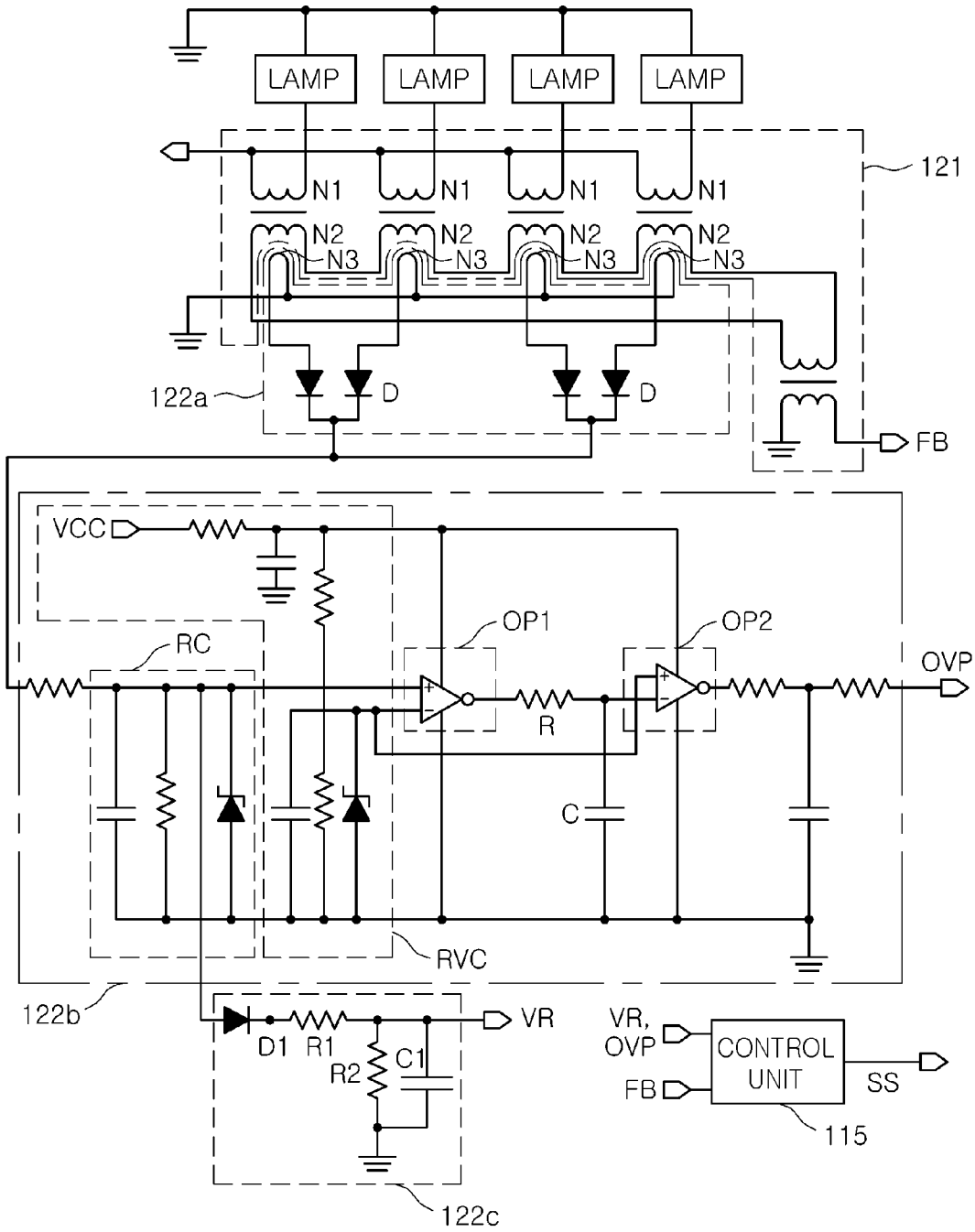
FIG. 2 is a schematic view illustrating a current balance circuit used in a power supply according to an exemplary embodiment of the present invention.

FIG. 2 is a schematic view illustrating the configuration of a current balance circuit used in the power supply according to an exemplary embodiment of the present invention.

Referring to FIGS. 1 and 2, the current balance unit 121 of the current balance circuit 120 may include a plurality of current balancing transformers corresponding to lamps on a one-to-one basis. The plurality of current balancing transformers may each have a primary winding N1 and a secondary winding N2.

The primary winding N1 receives lamp driving power from the transformer unit 114, and transmits the lamp driving power to each lamp.

The secondary winding N2 is electromagnetically coupled with the primary winding N1 to thereby form the current balancing transformer. The secondary winding N2 induces and receives the lamp driving power according to a turns ratio with the primary winding N1. The respective secondary windings N2 of the current balancing transformers are electrically connected to each other and form at least one loop, thereby maintaining a current balance state. The induced power may be provided to the control unit 115 as a feedback signal FB.

The protection unit 122 may include the detection part 122*a*, the delay transmission part 122*b* and the regulation part 122*c*.

The detection part 122*a* may include a plurality of tertiary windings N3 and a diode group D.

The plurality of tertiary windings N3 correspond to the primary and secondary windings N1 and N2 on a one-to-one basis, and are electromagnetically coupled with the corresponding primary and secondary windings N2, respectively, thereby forming the current balancing transformers. Accordingly, each tertiary winding N3 induces and receives power from the corresponding secondary winding N2 according to each turns ratio, and thus detects the voltage level of the lamp driving power.

The diode group D includes a plurality of diodes respectively corresponding to the tertiary windings N3, and rectifies the detected voltage from the tertiary windings N3.

The delay transmission part 122*b* may include a comparator OP1 comparing the detected voltage with a preset reference voltage, and a delay delaying the comparison result from the comparator OP1 by the preset time period and outputting the delayed comparison result.

First, the comparator OP1 compares the detected voltage having a level regulated by a regulation circuit RC with the voltage level of reference voltage set via a reference voltage circuit RVC.

The delay delays the comparison result from the comparator OP1 by a preset time period and outputs the delayed comparison result. Thus, the delay may include a capacitor C and a resistor R delaying the comparison result according to a set time constant, and a buffer OP2 outputting the delayed comparison result.

Accordingly, when the detected voltage has a higher level than the reference voltage, namely, when an abnormal operation such as an open-lamp occurs, the delay transmission part 122*b* may transmit a cut-off signal OVP to the control unit 115 after the predetermined time period.

Even if an abnormal operation such as an open-lamp may occur during this predetermined time period, the switching operation of the inverter unit 113 may be cut-off after the predetermined time period so that the overall operation of a backlight unit can be checked. Therefore, in order to protect components such as the winding of the current balancing transformer against the abnormal operation occurring during the predetermined time period, the regulation part 122*c* regulates the switching duty of the inverter unit 113 so as to cause the voltage level of the lamp driving power, being sent to each lamp, to be constant.

Namely, the regulation part 122*c* may include a diode D1, a resistor R1, a capacitor C1 and a discharge resistor R2. The diode D1 rectifies the detected voltage from the detection part 122*a*, reduces the rectified voltage according to a resistance value, the capacitor C1 is charged with the reduced voltage, and the discharge resistor R2 discharges the voltage charged in the capacitor C1.

Accordingly, the regulation part 122*c* charges/discharges the detected voltage to thereby output a control signal VR having an AC voltage. This is because the switching operation of the inverter unit 113 is stopped when a DC voltage having a constant level is applied to the input port of the control unit 115.

In detail, the cut-off signal OVP from the delay transmission part 122*b* and the control signal VR from the regulation part 122*c* are sent to the same output port of the control unit 115. Then, the control unit 115 accordingly sends a switching signal SS to the inverter unit 113. When the signal received via the input port is a DC signal, the control unit 115 outputs a switching signal for cutting-off the switching operation of the inverter unit 113. When the received signal is an AC signal, the switching signal output from the control unit 115 regulates the switching duty of the inverter unit 113 according to the received AC signal.

Figure 3:
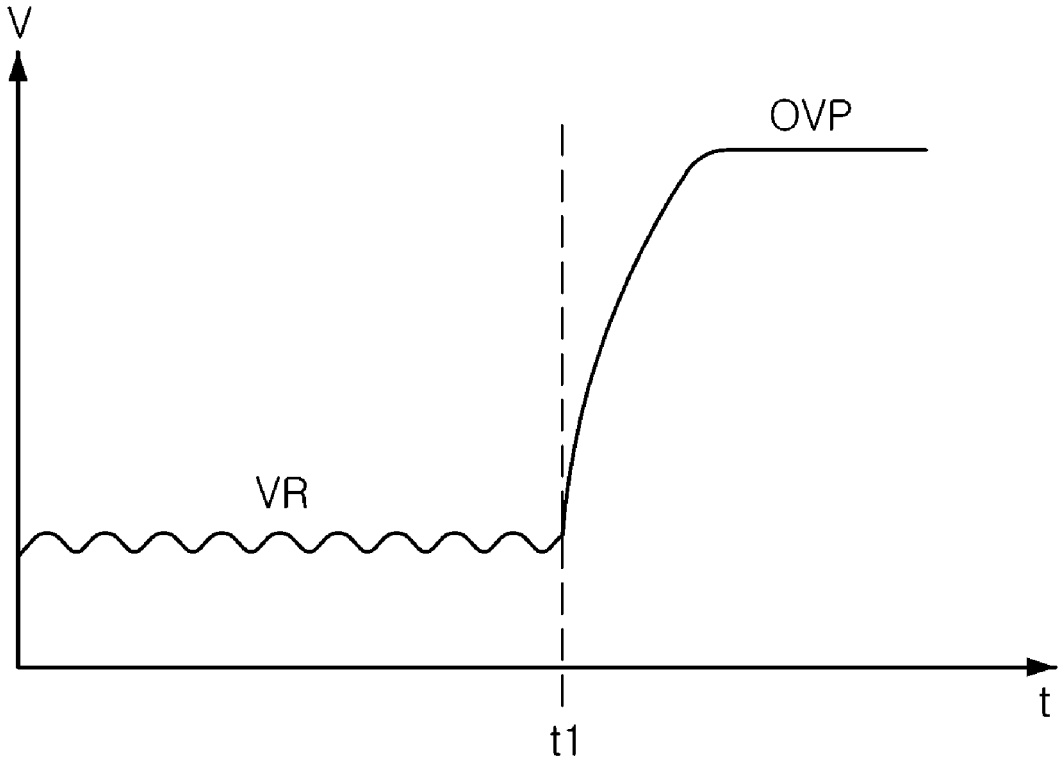
FIG. 3 is a signal graph of a current balance circuit used in a power supply according to an exemplary embodiment of the present invention.

FIG. 3 is a signal graph of the current balance circuit applied to a power supply according to an exemplary embodiment of the present invention.

Referring to FIGS. 1 through 3, the regulation part 122*c* of the current balance circuit 120, applied to the power supply 100 of the present invention, sends a control signal VR, an AC signal, to the control unit 115 in order to protect the winding of the current balance unit 121 during the predetermined time period t1 from an abnormal operation such as an open-lamp condition. In the case of the abnormal operation, the regulation part 122*c* sends a cut-off signal OVP to the control unit 115 after the predetermined time period t1 during which the backlight unit is checked.

As described above, the current balance circuit, having a protection function for protecting a device by detecting an abnormal lamp operation after a predetermined time in order to ensure a normal operation of lamps, can be prevented from being damaged during the predetermined time period.

As set forth above, according to exemplary embodiments of the invention, the current balance circuit having a protection function for protecting a device by detecting an abnormal lamp operation after a predetermined time period can be prevented from being damaged during the predetermined time period.

While the present invention has been shown and described in connection with the exemplary embodiments, it will be apparent to those skilled in the art that modifications and variations can be made without departing from the spirit and scope of the invention as defined by the appended claims.

What is claimed is:

1. A current balance circuit having a protection function, the current balance circuit comprising:

a current balance unit configured to maintain current balance of lamp driving power supplied to a lamp unit including a plurality of lamps; and a protection unit configured to detect the lamp driving power supplied to the lamp unit from the current balance unit, cut off the lamp driving power after a preset time period when the lamp unit operates abnormally, and control a voltage level of the lamp driving power to a preset reference voltage level or lower during the preset time period, wherein the current balance unit comprises a plurality of current balancing transformers corresponding to the plurality of lamps on a one-to-one basis and configured to maintain the current balance of the lamp driving power, each of the current balancing transformers comprises:

a primary winding configured to receive the lamp driving power and send the received lamp driving power to a corresponding lamp among the plurality of lamps; and a secondary winding electromagnetically coupled with the primary winding and electrically connected to an adjacent current balancing transformer among the plurality of current balancing transformers to form at least one loop and maintain the current balance, and the protection unit comprises:

a detection part configured to detect power induced from the secondary windings of the current balancing transformers;

a delay transmission part configured to delay a detected voltage from the detection part by the preset time period and send the delayed voltage to an outside circuit; and a regulation part configured to receive the detected voltage from the detection part and regulate the voltage level of the lamp driving power to the preset reference voltage level during the preset time period.

2. The current balance circuit of claim 1, wherein the detection part comprises:

a plurality of tertiary windings included in the plurality of current balancing transformers and configured to receive induced power from the respective secondary windings; and a diode group configured to rectify power from each of the plurality of tertiary windings.

3. The current balance circuit of claim 1, wherein the delay transmission part comprises:

a comparator configured to compare the detected voltage with a preset reference voltage; and a delay configured to delay a comparison result from the comparator by the preset time period and output the delayed comparison result.

4. The current balance circuit of claim 1, wherein the regulation part comprises:

a diode configured to rectify the detected voltage;

a resistor configured to reduce the rectified voltage from the diode;

a capacitor configured to be charged with the reduced voltage from the resistor; and a discharge resistor configured to discharge the voltage charged in the capacitor.

5. A power supply having a protection function, the power supply comprising:

a power supply circuit configured to convert commercial alternating current (AC) power into preset lamp driving power and supply the lamp driving power to a lamp unit including a plurality of lamps; and a current balance circuit comprising:

a current balance unit configured to maintain current balance of the lamp driving power supplied from the power supply circuit to each of the plurality of lamps; and a protection unit configured to detect the lamp driving power supplied to the lamp unit from the current balance unit, cut off the lamp driving power after a preset time period when the lamp unit operates abnormally, and control a voltage level of the lamp driving power to a preset reference voltage level or lower during the preset time period, wherein the current balance unit comprises a plurality of current balancing transformers corresponding to the plurality of lamps on a one-to-one basis and configured to maintain current balance of the lamp driving power, each of the current balancing transformers comprises:

a primary winding configured to receive the lamp driving power and send the received lamp driving power to a corresponding lamp among the plurality of lamps; and a secondary winding electromagnetically coupled with the primary winding and electrically connected to an adjacent current balancing transformer among the plurality of current balancing transformers to form at least one loop and maintain the current balance, and the protection unit comprises:

a detection part configured to detect power induced from the secondary windings of the current balancing transformers;

a delay transmission part configured to delay a detected voltage from the detection part by the preset time period and send the delayed voltage to the power supply circuit; and a regulation part configured to receive the detected voltage from the detection part and regulate the voltage level of the lamp driving power to the preset reference voltage level during the preset time period.

6. The power supply of claim 5, wherein the power supply circuit comprises:

a rectification unit configured to rectify and smooth the commercial AC power;

a power factor correction unit configured to correct a power factor of the rectified power from the rectification unit;

an inverter unit configured to switch the corrected power from the power factor correction unit;

a transformer unit configured to transform the switched power from the inverter unit into the lamp driving power; and a control unit configured to control a switching operation of the inverter unit according to a signal from the protection unit.

7. The power supply of claim 6, wherein the control unit is configured to adjust an ON/OFF duty of the inverter unit according to a control signal from the protection unit, and cut off the switching operation of the inverter unit according to a cut-off signal from the protection unit.

8. The power supply of claim 5, wherein the detection part comprises:

a plurality of tertiary windings included in the plurality of current balancing transformers and configured to receive induced power from the respective secondary windings; and a diode group configured to rectify power from each of the plurality of tertiary windings.

9. The power supply of claim 5, wherein the delay transmission part comprises:

a comparator configured to compare the detected voltage with a preset reference voltage; and a delay configured to delay a comparison result from the comparator by the preset time period and output the delayed comparison result.

10. The power supply of claim 5, wherein the regulation part comprises:

a diode configured to rectify the detected voltage;

a resistor configured to reduce the rectified voltage from the diode;

a capacitor configured to be charged with the reduced voltage from the resistor; and a discharge resistor configured to discharge the voltage charged in the capacitor.

* * * * *